US005363823A

United States Patent [19]

Gittlein

[11] Patent Number: 5,363,823

[45] Date of Patent: Nov. 15, 1994

[54] OIL COOLER

[76] Inventor: Michael Gittlein, 17442 W.C.R. 53, LaSalle, Colo. 80645

[21] Appl. No.: 87,203

[22] Filed: Jul. 2, 1993

[51] Int. Cl.[5] ..... F01M 5/00

[52] U.S. Cl. ..... 123/196 AB; 184/104.3; 165/916

[58] Field of Search ..... 123/196 AB; 184/104.3; 165/916

[56] References Cited

U.S. PATENT DOCUMENTS

| | | | |
|---|---|---|---|
| 3,223,197 | 12/1965 | Conover | 184/104.3 |
| 4,174,699 | 11/1979 | Gill | 123/196 A |
| 4,402,287 | 9/1983 | Cochran | 123/196 A |
| 4,423,708 | 1/1984 | Sweetland | 123/196 AB |
| 4,831,980 | 5/1989 | Nasu et al. | 123/196 AB |
| 5,014,775 | 5/1991 | Watanabe | 165/916 |

FOREIGN PATENT DOCUMENTS

| | | | |
|---|---|---|---|
| 0384316 | 8/1990 | European Pat. Off. | 165/916 |
| 1934193 | 9/1978 | Germany | 123/196 AB |
| 62-17594 | 1/1987 | Japan | 165/916 |

OTHER PUBLICATIONS

J. C. Whitney Catalog No. 288, 1971 p. 108, Chicago, Ill.

*Primary Examiner*—E. Rollins Cross
*Assistant Examiner*—Erick Solis

[57] ABSTRACT

An oil cooler unit is described for use in combination with an internal combustion engine to cool the oil in the engine. The oil cooler can be threaded onto the oil filter mounting plate, and an oil filter can be threaded onto the opposite end of the oil cooler. As heated oil proceeds through the cooler, heat is dissipated through fins secured to the body of the oil cooler unit.

5 Claims, 7 Drawing Sheets

OIL COOLER

FIELD OF THE INVENTION

This invention relates to techniques and systems for cooling fluid. More particularly, this invention relates to devices for use in cooling fluid (e.g., oil) in an internal combustion engine.

BACKGROUND OF THE INVENTION

The moving components of an internal combustion engine are lubricated by means of oil. Upon extended operation of an engine the oil can become very hot. Although water-cooled engines are normally prevented from becoming too hot by means of the water cooling system (including an external radiator), conventional air-cooled engines must rely on movement of air past the surfaces of the engine for cooling. Fins on the engine assist in dissipating heat from the engine during operation. When the air temperature is high, the temperature of the engine, and the lubricating oil contained in the engine, may rise to harmful levels.

When the oil temperature is too high, the oil may break down and lose its ability to effectively lubricate the moving components of the engine. Damage to the engine can also result.

There has not heretofore been provided a simple, easy-to-use, and effective oil cooler for use on internal combustion engines.

SUMMARY OF THE PRESENT INVENTION

In accordance with the present invention there is provided an oil cooler unit which can be easily installed on an internal combustion engine for the purpose of cooling the oil in the engine. In a preferred embodiment the oil cooler unit comprises a body member having threaded recesses on opposite ends and a plurality of openings or conduits extending longitudinally through the length of the body. A plurality of spaced-apart fins extend outwardly from the body.

One end of the oil cooler is adapted to be threadably mounted on to the threaded nipple of the existing assembly on an engine to which an oil filter is normally attached. The oil filter is then threadably secured to the opposite end of the oil cooler body. Oil can then flow from the engine, through the longitudinal conduits in the oil cooler body, and then into the oil filter. The heated oil heats the oil cooler body and the fins, whereby heat becomes dissipated into the surrounding air through the fins.

The oil filter unit can be provided in any desired size and shape. It can be used on any internal combustion engine for the purpose of dissipating heat from the oil in the engine.

Other advantages of the oil cooler unit of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
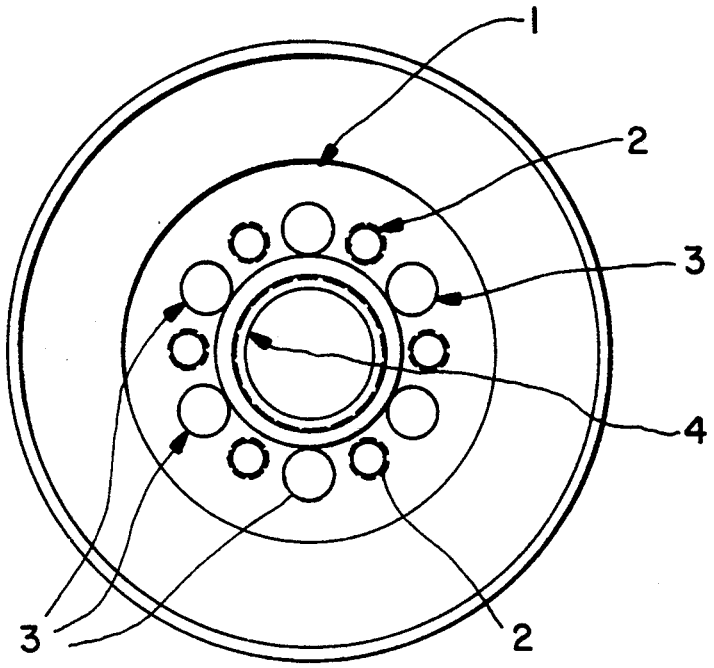
FIG. 1 is an end elevational view of one embodiment of oil cooler of the invention.
Figure 2:
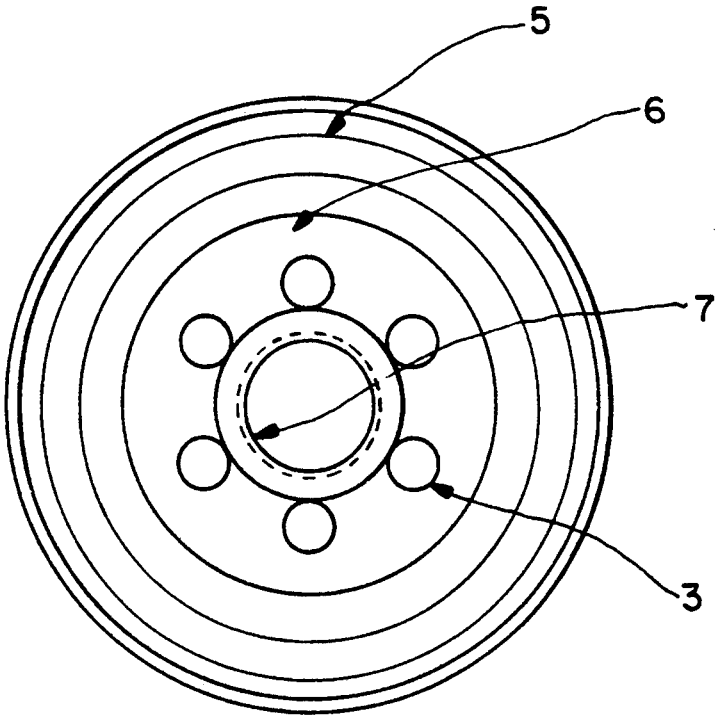
FIG. 2 is an elevational view of the opposite end of the oil cooler unit of FIG. 1.
Figure 3:
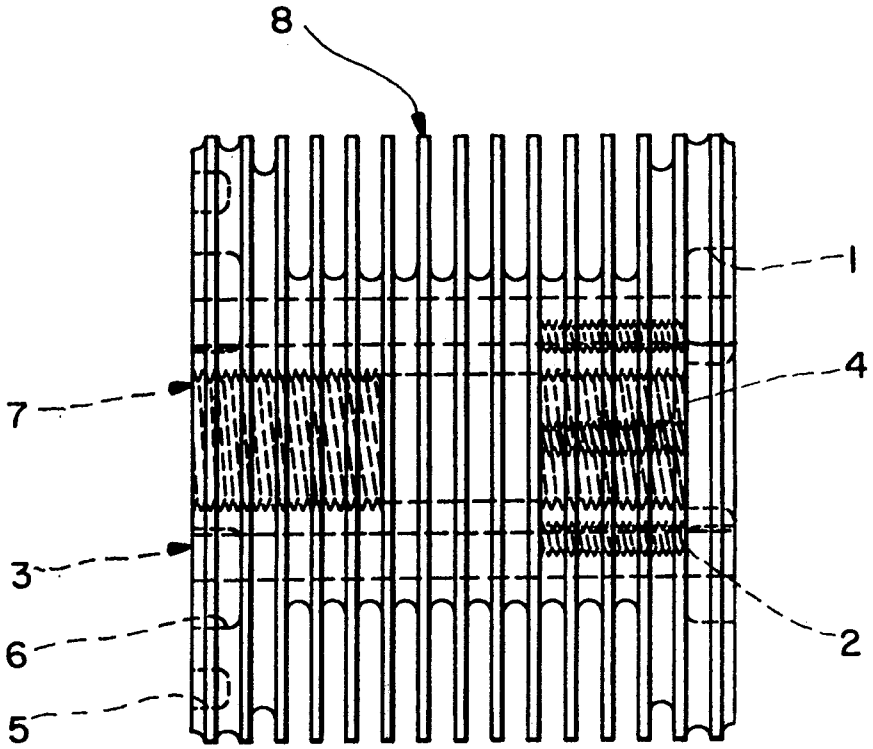
FIG. 3 is a side elevational view of the oil cooler of FIG. 1.
Figure 4:
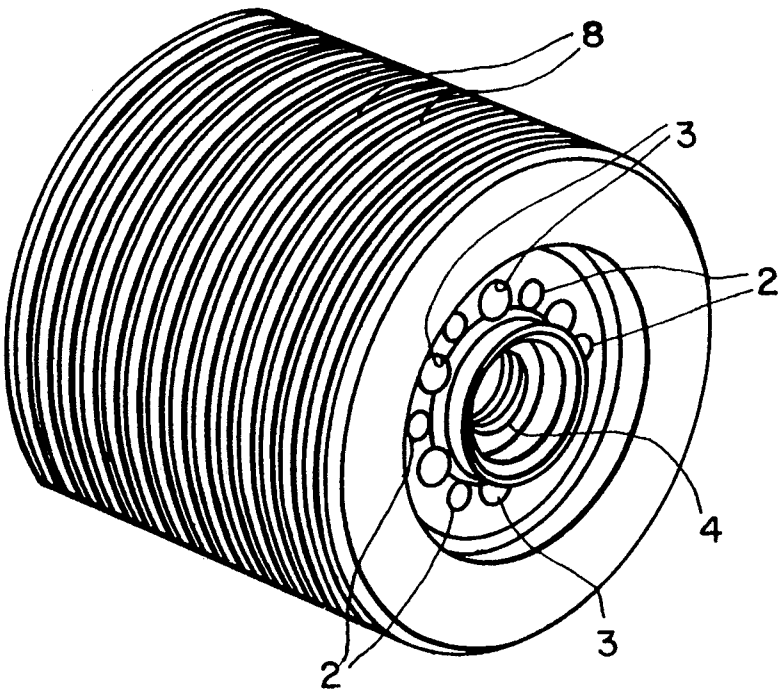
FIG. 4 is a perspective view of the oil cooler unit.

In the drawings there is shown an oil cooler unit comprising a cylindrical body having generally parallel end faces. On one end of the body there is a threaded recess 4 for receiving a threaded nipple to facilitate attachment of a conventional oil filter to this end of the cooler body. On the opposite end of the cooler body there is a threaded recess 7 to enable the cooler body to be threaded onto a nipple on the existing oil filter assembly on an engine.

Longitudinal openings or conduits 3 extend through the entire length of the cooler body for the purpose of allowing heated oil from the engine to flow through the cooler body to the oil filter. The number and size of these conduits may vary, as desired. Preferably these conduits are parallel to the central axis of the cooler body. Machined cavity 1 in one end of the cooler body provides access for the oil to enter conduits 3. A similar machined cavity 6 is located in the opposite end of the cooler body. Machined annular cavity 5 in one end of the cooler body is for the purpose of accommodating an O-ring or gasket to provide a seal between the end of the cooler body and the existing oil filter attachment base on the engine.

Figure 5:
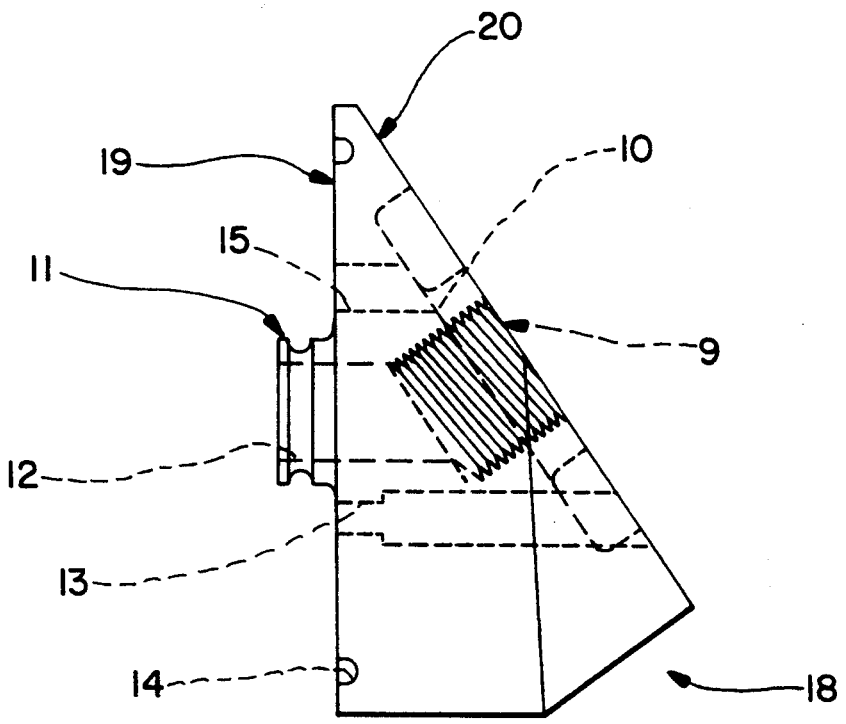
FIG. 5 is a side elevational unit of an angle connecting adaptor which is useful in connecting the oil cooler unit between an engine and an oil filter.
Figure 6:
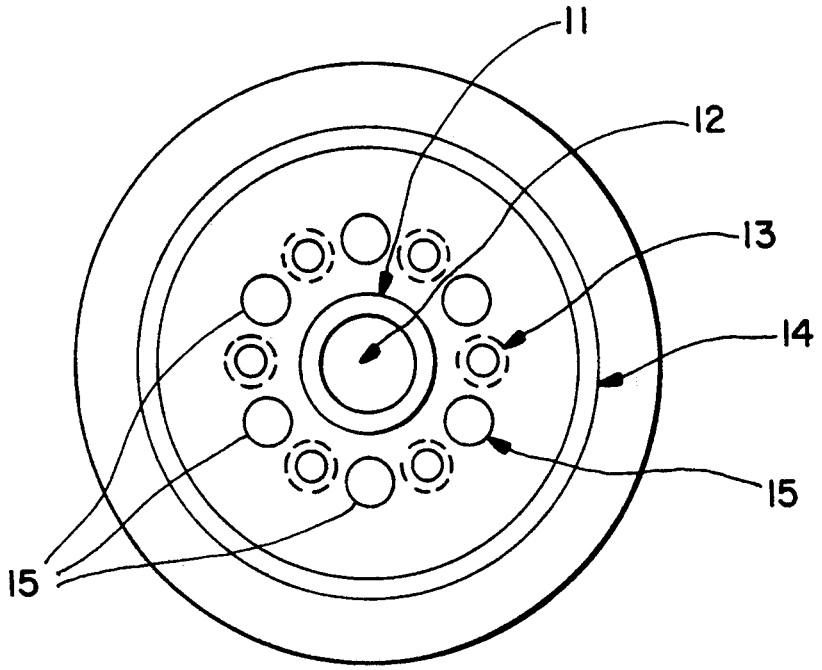
FIG. 6 is an end view of the connecting adaptor shown in FIG. 5.

FIG. 5 and 6 illustrate an angle adaptor which may be used, if desired, in combination with the oil cooler body of FIGS. 1–4. This type of adaptor is very useful when installing the oil cooler unit on an engine (e.g., a Harley Davidson motorcycle) where it is necessary to provide clearance for the oil filter and avoid interference with the frame or linkages, etc. of the vehicle.

The adaptor 18 of FIGS. 5 and 6 has two attachment faces 19 and 20, as shown, which are at an angle to each other. The angle between the faces may vary (e.g., from 1° to 90°). The angle shown in the embodiment of FIG. 5 is approximately 40°, but the adaptor may be manufactured with any desired angle between the two faces.

Face 19 of the adaptor is secured to one end of the oil cooler body by means of bolts or screws which extend through openings 13 of the adaptor and into threaded holes 2 in one end of the oil cooler body. A threaded nipple is threaded into threaded opening 9 in the adaptor face 20. A conventional oil filter 21 can then be threaded onto the nipple until the oil filter is tight against face 20 of the adaptor 18 as shown in FIG. 7.

A machined cavity 10 in face 20 is for the purpose of providing access for oil to enter the filter after passing through the oil cooler body and the adaptor. The adaptor includes conduits 15 which extend through the adaptor for oil passage.

Nipple 11 on face 19 of the adaptor includes an opening 12 extending longitudinally therethrough for enabling oil to return to the oil cooler body from the oil filter attached to face 20. Annular cavity 14 in face 19 is for receiving an O-ring or gasket for sealing to the end face of the oil cooler body.

Figure 7:
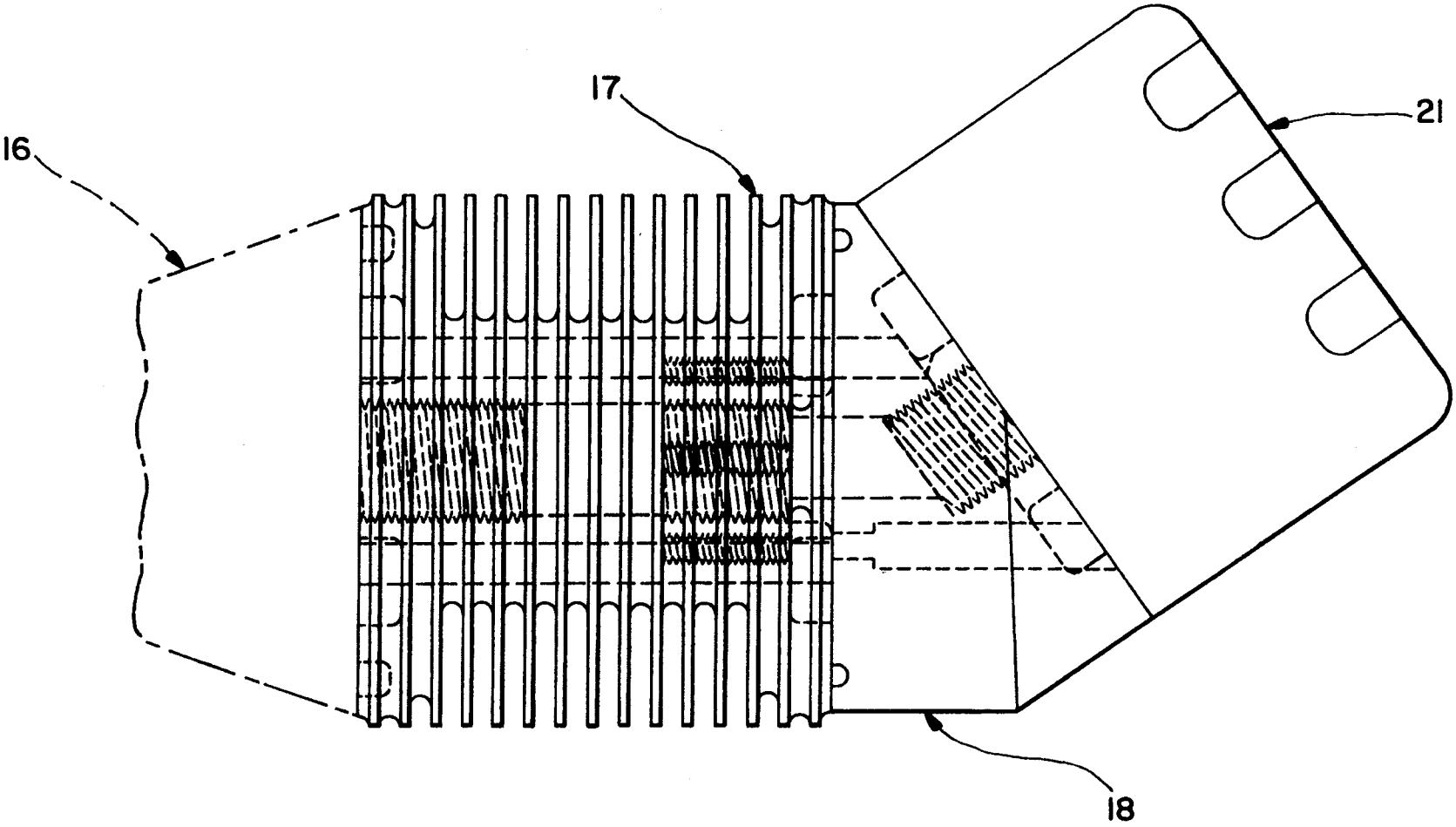
FIG. 7 is a side-elevational view illustrating the oil cooler unit, connecting adaptor, and an oil filter in combination.

As shown in FIG. 7, the oil cooler unit 17 may be attached at one of its ends to a conventional oil filter attachment bracket or housing 16 which may be attached directly to certain types of engines (or is located remotely on the frame of the vehicle and is connected to the engine with oil lines). The angle adaptor 18 is shown attached to the opposite end of the oil cooler unit, if desired. The conventional oil filter 21 is attached to one face of the adaptor, as shown. Of course, the oil filter can be attached directly to the oil cooler unit when the adaptor 18 is not used.

The oil cooler unit of this invention is very easy and rapid to install on an internal combustion engine. The spin-on concept utilized herein avoids the need for attachment hardware, cumbersome plumbing, hoses, etc. The present invention also avoids leakage problems.

The oil cooler unit is very compact and is also efficient in dissipating heat from the engine oil to the atmosphere. Other variants are possible without departing from the scope of this invention. The oil cooler unit may be composed of any durable material such as metal (e.g., aluminum) which is capable of conducting thermal energy therethrough. The length and diameter of the body member may vary. The thickness and spacing of the fin members may also vary.

What is claimed is:

1. An oil cooler comprising:

(a) a body member having a central axis, first and second ends and a plurality of longitudinal conduits extending through said body member parallel to said central axis; wherein each said end of said body member includes a threaded attachment aperture; and wherein each said end of said body member includes a cavity which communicates with said conduits;

(b) a plurality of spaced-apart fin members secured to said body member and extending outwardly from said body member for dissipating heat from heated fluid passing through said conduits.

2. An oil cooler in accordance with claim 1, wherein said fin members are perpendicular to the longitudinal axis of said body member.

3. An oil cooler in accordance with claim 1, wherein said body member and said fin members are integral and are composed of metal.

4. A combination comprising:

(a) an oil cooler in accordance with claim 1;

(b) an angle adaptor detachably mounted to said first end of said oil cooler; wherein said adaptor includes first and second faces and conduits extending through said adaptor between said faces.

5. A method for cooling oil from an internal combustion engine comprising the steps of:

(a) providing an oil cooler comprising:

(1) a body member having a central axis, first and second ends and a plurality of longitudinal conduits extending through said body member parallel to said central axis; wherein each said end of said body member includes a threaded attachment aperture; and wherein each said end of said body member includes a cavity which communicates with said conduits;

(2) a plurality of spaced-apart fin members secured to said body member and extending outwardly from said body member for dissipating heat from heated fluid passing through said conduits;

(b) attaching one of said ends of said oil cooler to said engine in a manner such that oil from said engine can flow into said conduits in said oil cooler;

(c) attaching an oil filter to the opposite end of said oil cooler.

* * * * *